US007112099B2

(12) United States Patent
Ma

(10) Patent No.: US 7,112,099 B2
(45) Date of Patent: Sep. 26, 2006

(54) AUDIO JACK CONNECTOR

(75) Inventor: Zuedong Ma, Jinagsu (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/545,154

(22) PCT Filed: Mar. 9, 2004

(86) PCT No.: PCT/US2004/007209

§ 371 (c)(1),
(2), (4) Date: Aug. 10, 2005

(87) PCT Pub. No.: WO2004/086570

PCT Pub. Date: Oct. 7, 2004

(65) Prior Publication Data

US 2006/0166561 A1 Jul. 27, 2006

(30) Foreign Application Priority Data

Mar. 21, 2003 (CN) ..... 03 2 38875

(51) Int. Cl.
*H01R 24/04* (2006.01)

(52) U.S. Cl. ..... 439/668

(58) Field of Classification Search ..... 439/668, 439/669, 188
See application file for complete search history.

(56) References Cited

U.S. PATENT DOCUMENTS 4,867,708 A * 9/1989 Iizuka ..... 439/668
6,312,274 B1 * 11/2001 Lin ..... 439/668
6,690,801 B1 * 2/2004 Yeh ..... 439/668
6,821,163 B1 * 11/2004 McHugh et al. ..... 439/733.1

* cited by examiner

*Primary Examiner*—Tho D. Ta

(57) ABSTRACT

An audio jack connector comprises an insulative housing and a plurality of terminals. The housing has a mating face, and the mating face is joined to a top face and bottom face. The housing defines slots where the openings of the slots are located at the bottom face and extend to the top face. The mating face defines a jack cavity communicating with the slots. The plurality of terminals are disposed in the slots, and each terminal has a base portion. One end of the base portion forms a resilient arm reversely bent toward the top face. A free end of the resilient arm forms a hemispherical contact portion, and the other end of the base portion is bent to form a soldering portion. The soldering portion extends out of the slot and is located within the periphery of the bottom face. The terminals are respectively received in the slots of the housing and are fixed to the slots through the base portions thereof.

1 Claim, 9 Drawing Sheets

AUDIO JACK CONNECTOR

FIELD OF THE INVENTION

The present invention relates to an audio jack connector, and more particularly to an audio jack connector which is disposed in a communication device for electrical connection with a mating audio connector.

BACKGROUND OF THE INVENTION

Communication devices are being developed to be quickly attachable to other devices while continuing to be portable with reduced dimensions and reduced weight. Therefore, manufacturers are designing every component of the mobile phone to have reduced dimension and weight. At the same time manufacturers must ensure that all the electrical connections are good to maintain the quality of signal transmission. The basic function of the mobile phone is to receive and transmit voice, and, more recently, images and the Internet. As is well known, the mobile phone has an audio connector which receives a connector for an earphone.

Referring to FIG. 1, a conventional audio jack connector in the prior art includes an insulative housing 5 and a plurality of terminals 7. The outer surface 50 of the insulative housing 5 is flat, and the terminals 7 are bent into different shapes, and received in the insulative housing 5. Each terminal 7 has a plurality of interfering tabs 70 to be fixed to the insulative housing 5. The insulative housing 5 forms projections 52 to limit the position of the terminal 7. The insulative housing 5 further defines a raised opening 51 for the insertion of a mating audio connector (not shown) thereinto to electrically engage with the terminals 7.

To prevent the terminals from contacting each other while still being able to engage the terminals of a mating connector and to be soldered to a printed circuit board, the terminals are bent into different shapes. A plurality of interfering tabs are provided on the terminals to ensure the terminals are firmly held in the housing. The projections 52 used to limit the movement of the terminals increases the dimensions of the insulative housing which increases the cost of manufacture.

SUMMARY OF THE INVENTION

The main object of the present invention is to provide an audio jack connector whose terminals have reduced dimensions and are simple in design and easy to assemble. Another object of the present invention is to provide an audio jack connector whose insulative housing is portable and has reduced dimensions.

To fulfill the above-mentioned objects, the present invention provides an audio jack connector, which is disposed in a communication device, with one portion electrically connected to a printed circuit board and the other portion designed to receive terminals of a mating audio connector. This connector includes an insulative housing and a plurality of terminals. The housing has a mating face and a rear face connected to a top face and bottom face, which are opposed to each other. The insulative housing defines slots, which are open at the bottom face and extend to the top face. The mating face defines a plug receiving opening which communicates with the slots. The plurality of terminals are disposed in the slots where each terminal has a base portion. A resilient arm, extending from one end of the base portion, is reversely bent toward the top face with a free end of the resilient arm forming a contact portion. A soldering portion extending from the other end of the base portion.

The slot of the insulative housing includes an internal wall face which includes two opposed side walls. The faces of the side walls form two symmetric projecting bars with two symmetric grooves respectively formed between the two projecting bars. Side edges of the base portion of the terminals are received in the two symmetric grooves. The grooves extend from the bottom face to the top face of the housing. The resilient arm extends reversely from one end of the base portion of each terminal adjacent to the top face. Side edges of the base portion of the terminal form interfering tabs. The interfering tabs are designed to be fixed to an inner surface of the two grooves. The bottom face of the insulative housing further includes a projecting post for locating the housing to a printed circuit board. The contact portion of the terminal has a projecting face, the projecting face being located at one side of a central axis of the jack of the insulative housing. The mating audio connector is inserted into the jack and electrically engages the terminals. The soldering portion of each terminal extends out of the slot of the insulative housing and is located at an outer periphery of the bottom face of the insulative housing. The insulative housing further defines a slit and a switch terminal. The switch terminal is received in the slit with one end of the switch terminal electrically engaging the free end of the resilient arm of the terminal. The slots are oriented at two opposite sides of the jack cavity, where the two slots are near the side edge of the housing and other two slots are located away from the side edge of the housing. The slots also can be oriented with three slots near the side edge of the housing and one slot away from the side edge of the housing.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
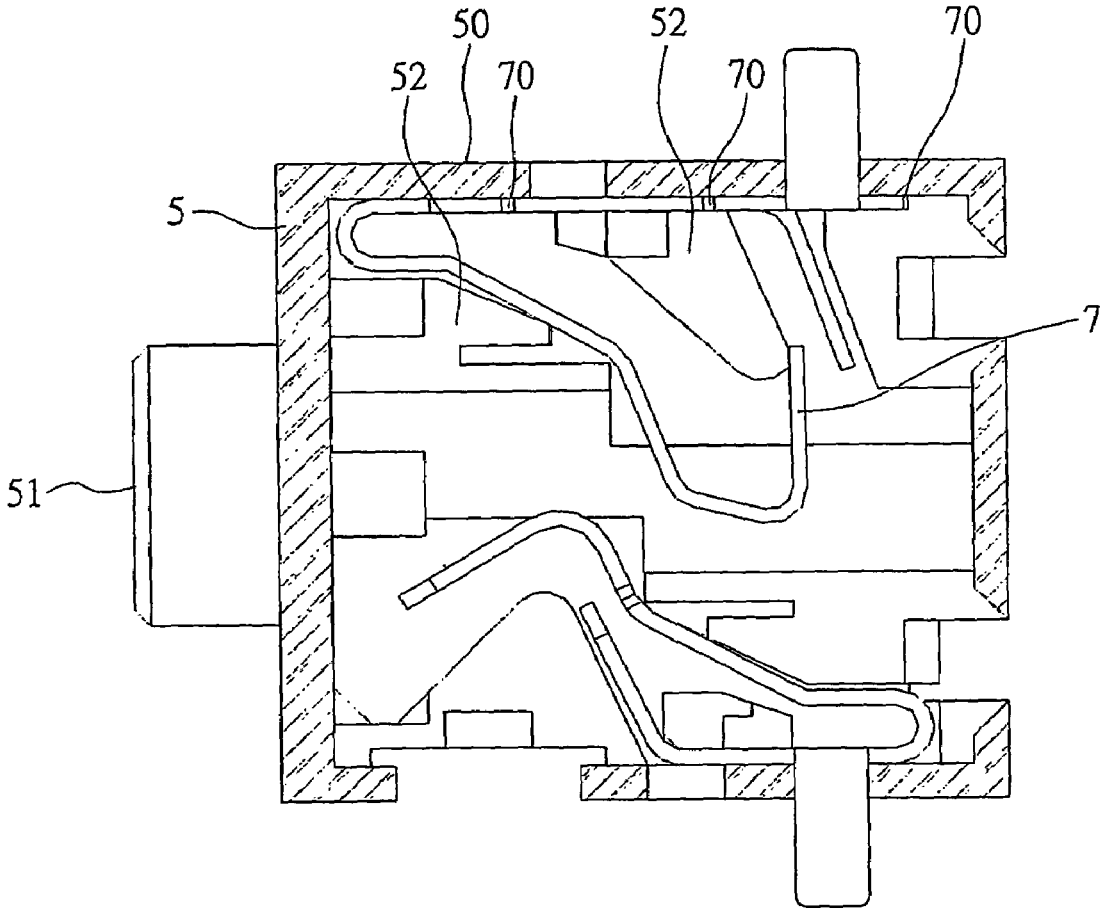
FIG. 1 PRIOR ART
FIG. 1 is a cross-sectional view of a conventional audio jack connector in the prior art.

Two embodiments of the present invention are illustrated below. Referring to FIGS. 2 to 7, an audio jack connector according to the first embodiment of the present invention is disposed in a communication device and is electrically connected with a printed circuit board for electrical connection with an external mating audio connector, and comprises an insulative housing and a plurality of terminals.

The insulative housing 1 has a mating face 17. The mating face 17 is joined to a top face 19 and a bottom face 20 which faces are opposed to each other. The insulative housing 1 has slots 11 with openings of the slots 11 being located in the bottom face 20 and extending to the top face 19. The mating face 17 defines an aperture 18 which communicates with the slots 11. The bottom face 20 of the insulative housing 1 further includes a projecting post 16 for locating the housing to the printed circuit board (not shown).

The plurality of terminals 3 are disposed in the slots 11. Each terminal 3 has a base portion 30. A resilient arm 33 extends from one end of the base portion 30 and is bent reversely toward the top face 19. A free end of the resilient arm 33 forms a hemispherical contact portion 34. A soldering portion 32 extends from the other end of the base portion 30. The soldering portion 32 passes through the slot 11 and is located within the periphery of the bottom face 20 of the insulative housing 1. Side edges of the base portion 30 of each terminal 3 form a plurality of interfering tabs 31 which are fixed to the inner surface of the slot.

The inner surface of the slot 11 of the insulative housing 1 includes an internal wall face 12 which is joined to two opposed side wall faces 13. The sidewall faces 13 form two symmetric projecting bars 14, and two symmetric grooves 15 which are respectively formed between the two projecting bars 14. The side edges of the base portion 30 of the terminals 3 are received in the two symmetric grooves 15. The interfering tabs 31 are fixed to the sidewall faces 13 of the slots 11.

Figure 7:
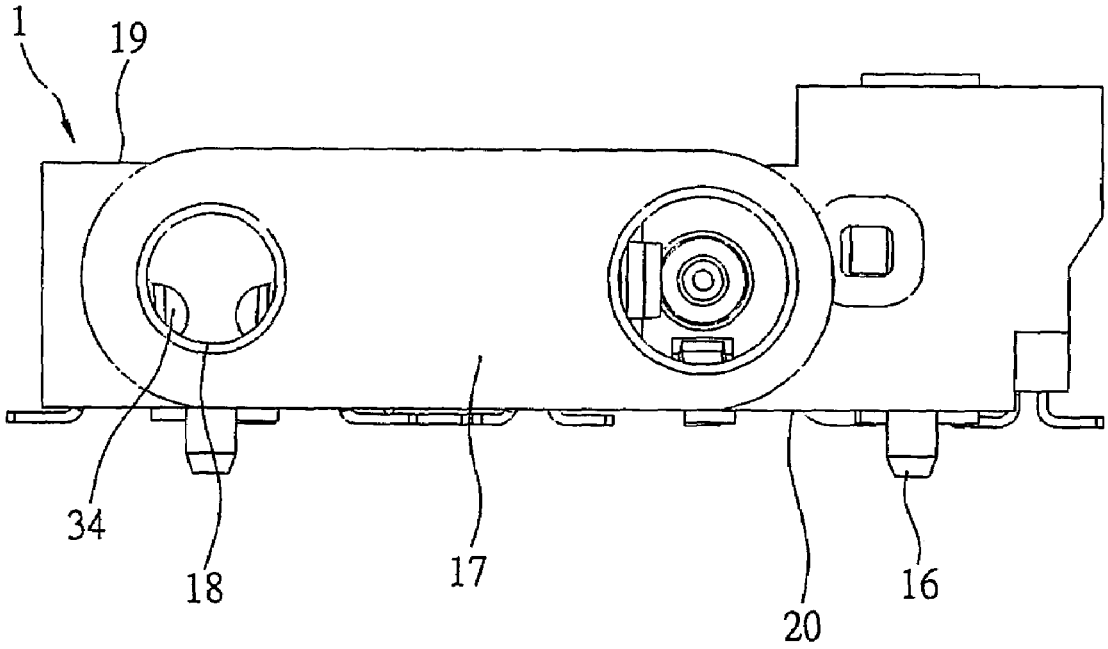
FIG. 7 is a front view of a mating face of an audio jack connector of the present invention.

Referring to FIG. 7, the contact portion 34 of each terminal 3 has a projecting face which is located at one side of a central axis of the aperture 18 of the insulative housing 1, and the mating audio connector (not shown) is inserted into the aperture 18. Referring to FIGS. 2 to 6, the slots 11 are located at two opposite sides of the aperture 18. Two slots 11 are located near the side edge of the housing 1 and other two slots 11 are located away from the side edge of the housing 1. Further referring to FIGS. 8 and 9, which disclose an alternative embodiment, the slots 11 are located at two opposite sides of the aperture 18, wherein three slots 11 are located near the side edge of the housing 1 and one slot 11 is located away from the side edge of the housing 1. The orientation of the slots 11 may be designed and arranged differently according to the arrangement of the audio jack connector terminals which must match with the corresponding portions of the mating audio connector.

The terminal 3 is simply designed to coincide with the slot 11 of the insulative housing 1, and the slot 11 provides space for the resilient arm 33 and the contact portion 34 extending from the terminal 3 to facilitate the manufacture and assembly of the connector. The terminal 3 is fixed to the groove 15 of the slot 11 only by the interfering tabs 31 formed on the side edges of the base portion 30. The terminal does not require bending or projections in the housing. Therefore, the height and the amount of material for the insulative housing 1 is reduced. Because the slots 11 of the insulative housing 1 extend from the bottom face 20 through the top face 19, the resilient arm 33 is reversely bent from one end of the base portion 30 of the terminal 3 toward the top face 19. Therefore, the height between the top face 19 and the bottom face 20 is lowered. Furthermore, the soldering portion 32 is directly formed by bending the base portion 30 and is exposed outside of the bottom face 20, such that a visible check of the quality of the solder joint can be made.

Figure 2:
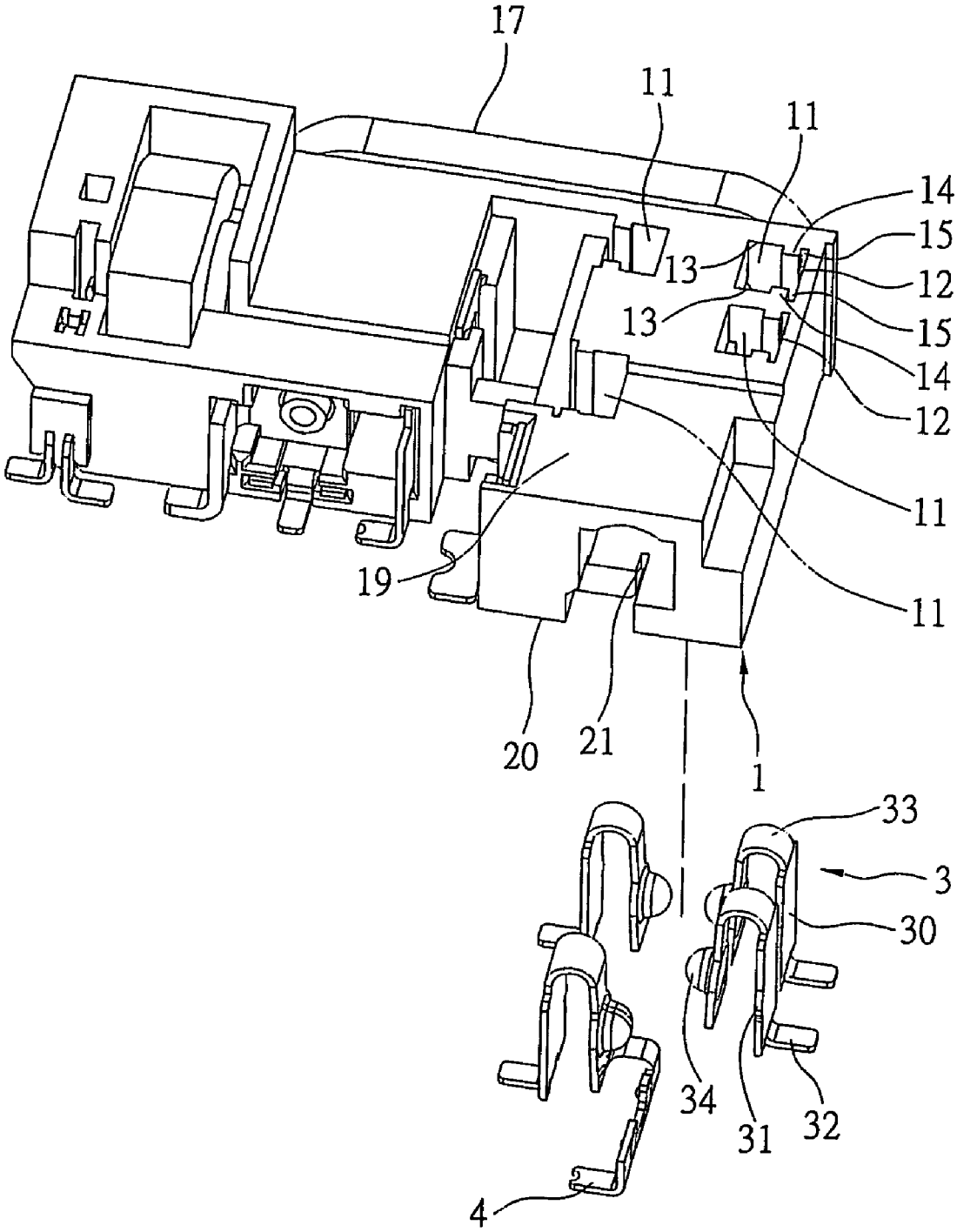
FIG. 2 is an exploded perspective view of an audio jack connector of the present invention.
Figure 3:
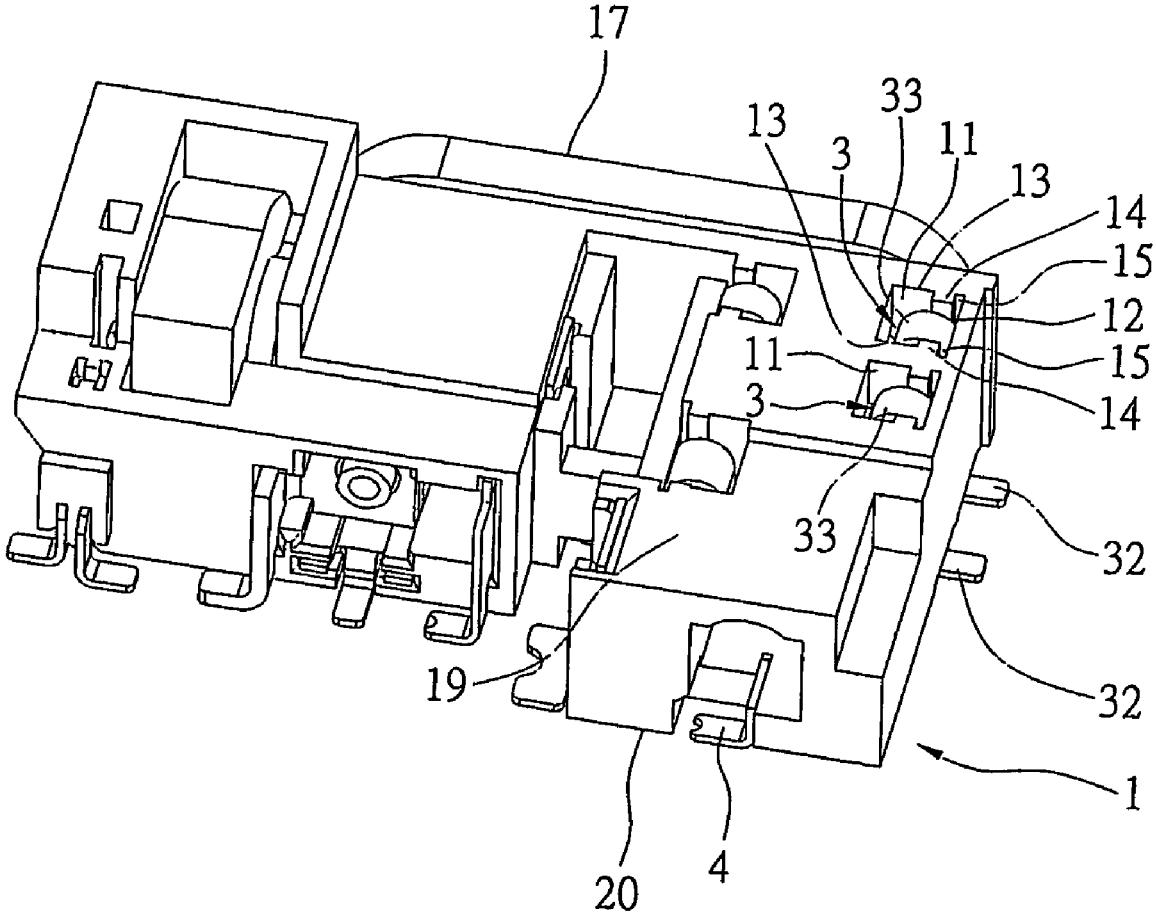
FIG. 3 is an assembled perspective rear view of an audio jack connector of the present invention.
Figure 4:
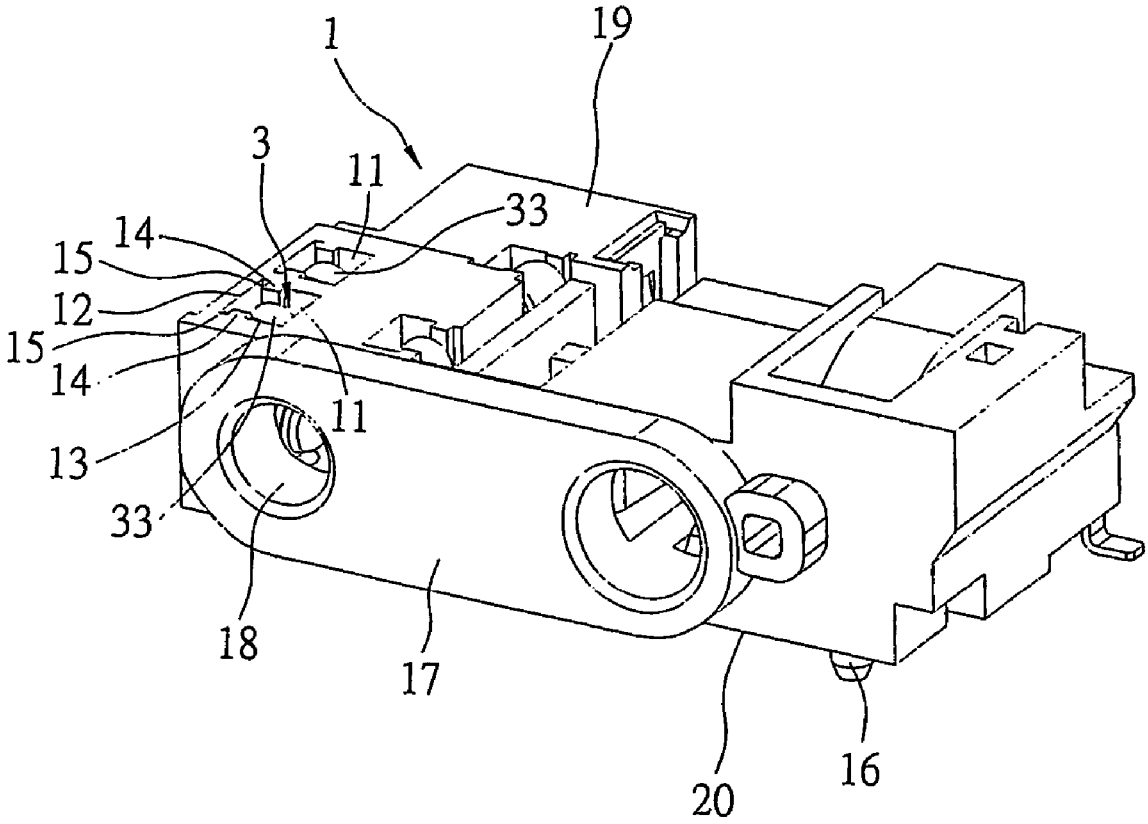
FIG. 4 is an assembled perspective front view of an audio jack connector of the present invention.
Figure 5:
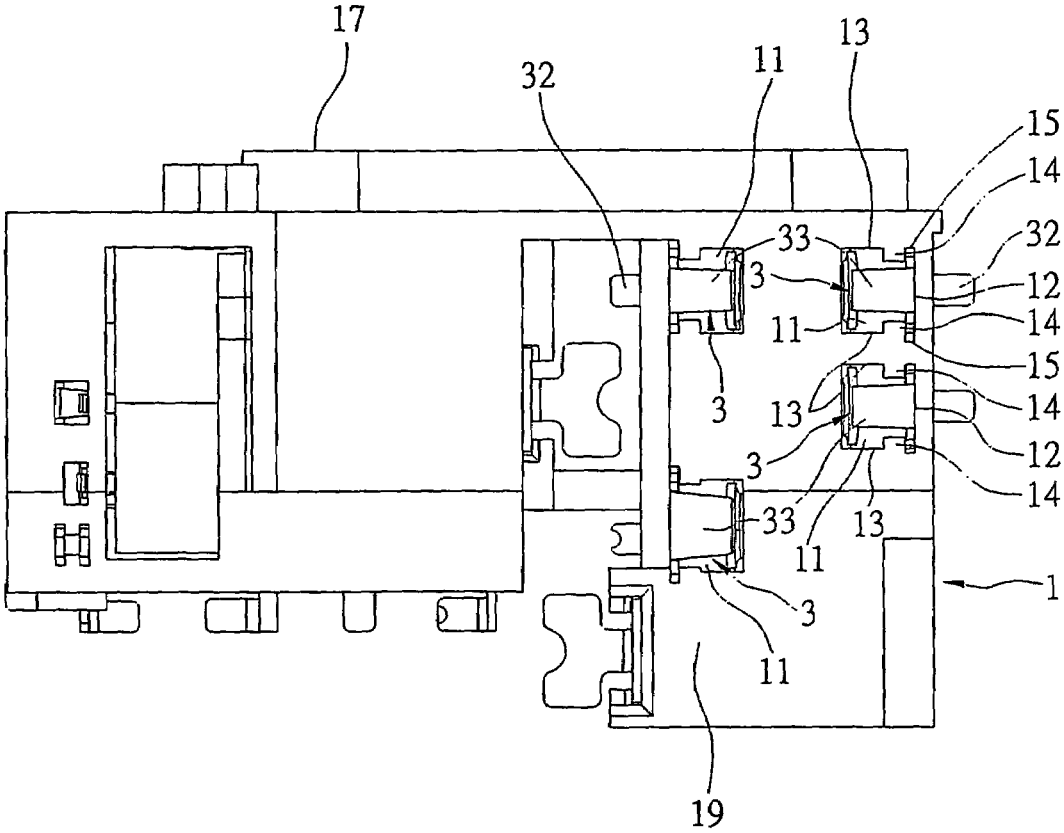
FIG. 5 is a top view of an audio jack connector of the present invention.
Figure 6:
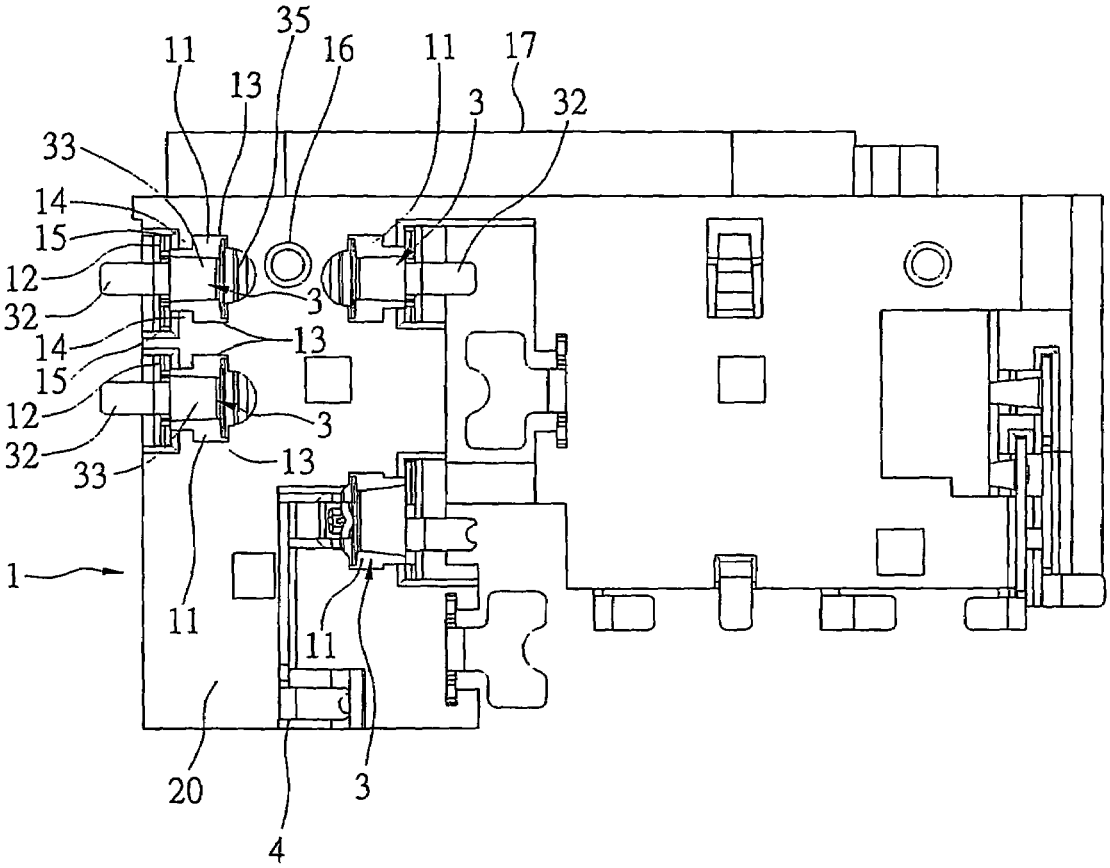
FIG. 6 is a bottom view of an audio jack connector of the present invention.
Figure 8:
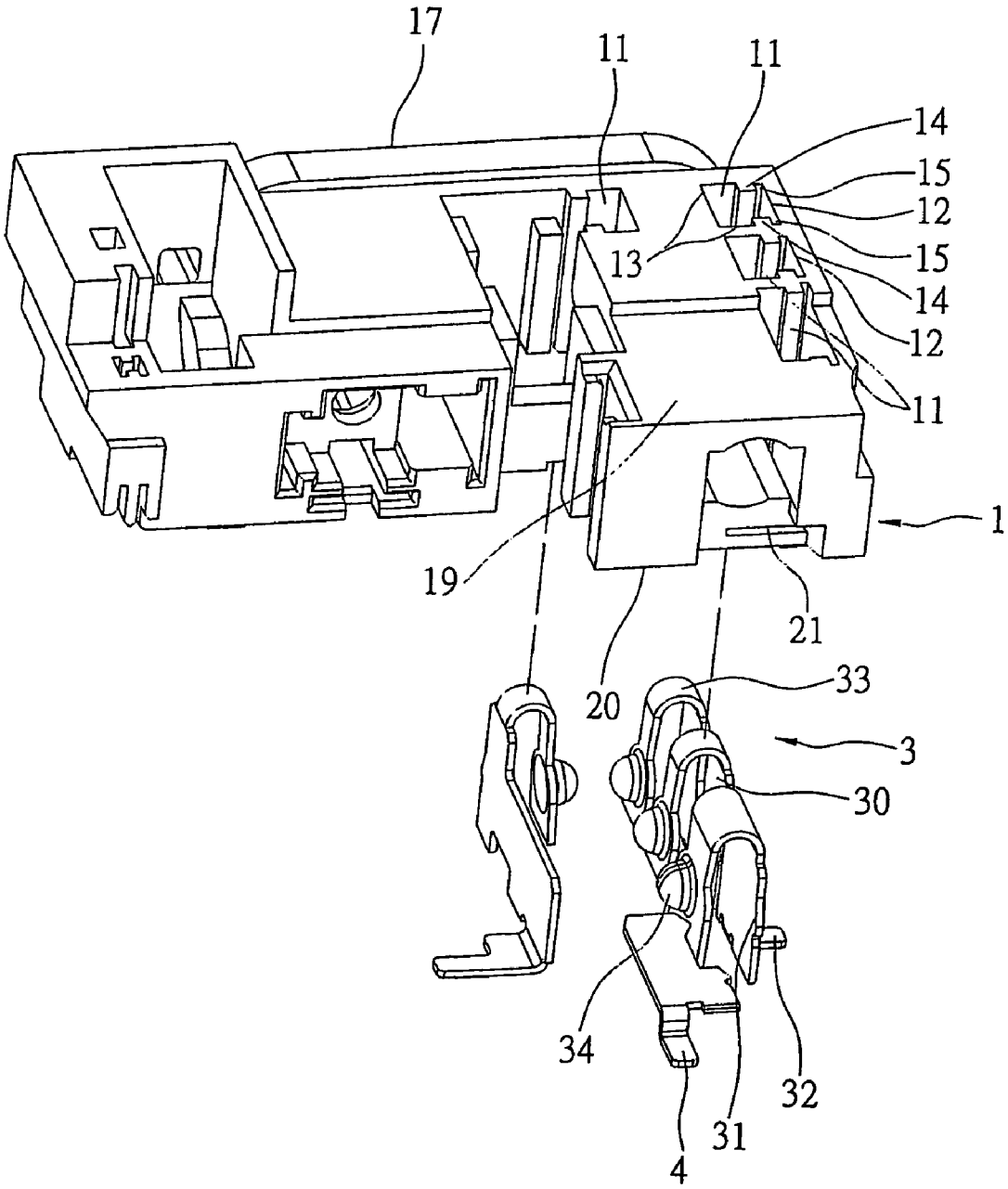
FIG. 8 is an exploded perspective rear view of an audio jack connector according to another embodiment of the present invention.
Figure 9:
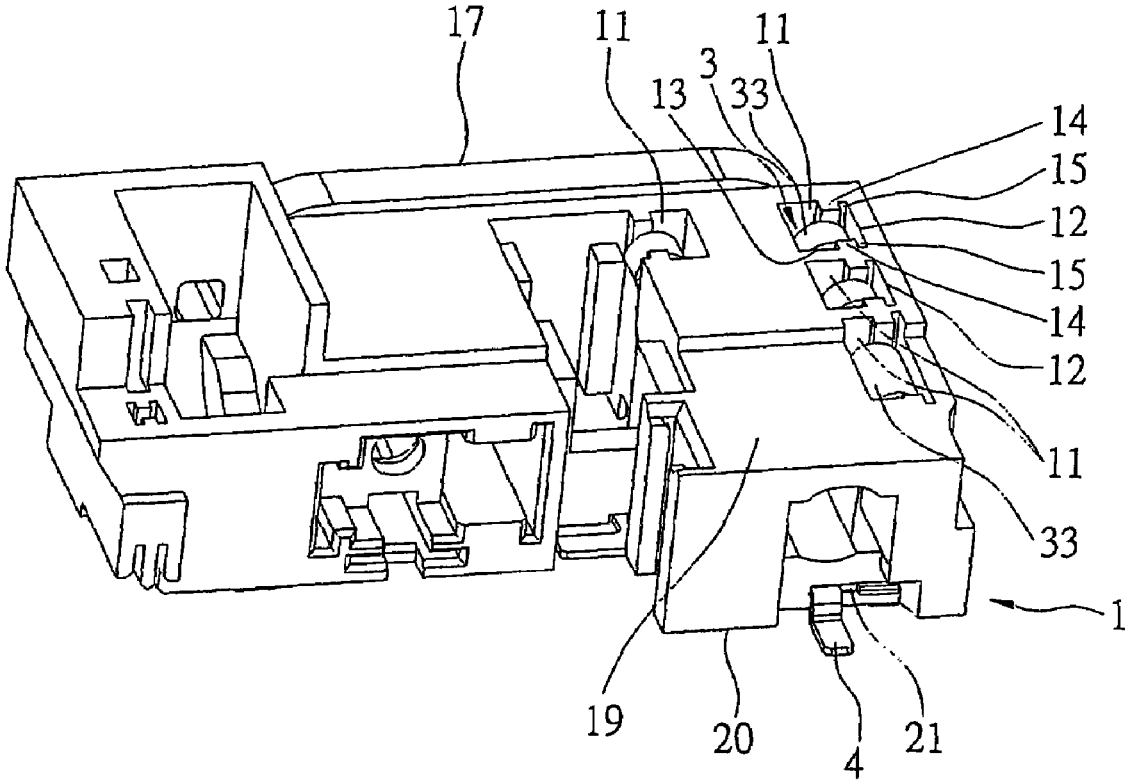
FIG. 9 is an assembled perspective view of an audio jack connector according to another embodiment of the present invention.

Referring to FIGS. 2 and 8, the insulative housing 1 further defines a slit 21 with a terminal 4 being received in the slit 21. When the mating audio connector is not inserted into the aperture 18, one end of the terminal 4 electrically engages the free end of the resilient arm 33 of the terminal 3 so as to ensure that voice is sent out by of speaker of the communication device. When the mating audio connector is inserted into aperture 18 and electrically engages terminal 3, the mating audio connector pushes the free end of the resilient arm 33 of the terminal 3 out of electrical engagement with terminal 4 to form an open circuit so as to ensure that voice is transmitted by the mating audio connector to an earphone instead of to the speaker of the communication device.

Although several embodiments of the present invention have been illustrated and described, it is not intended to limit the present invention. Rather, those skilled in the art may make various modifications of the invention without departing from the spirit and scope of the present invention. So, what the present invention intends to protect is based on the claims defined by the present application.

What is claimed is:

1. An audio jack connector, disposed in a communication device and electrically connected to a printed circuit board for electrical connection with a mating audio connector, comprising:

an insulative housing having a mating face and side edges, the mating face joined to two opposed top and bottom faces, the insulative housing defining slots with openings of the slots located in the bottom face and extending to the top face, the mating face defining an aperture opening to a connector receiving channel communicating with the slots;

a plurality of terminals disposed in the slots and insertable from the openings of the slots located in the bottom face, each terminal having a base portion, a resilient arm extending from one end of the base portion and bent reversely toward the top face, a free end of the resilient arm forming a hemispherical contact portion designed to engage conductors on the mating audio connector when inserted in the connector receiving channel, and a soldering portion extending from another end of the base portion designed to be soldered to the printed circuit board, the slots being oriented at two opposite sides of the connector insertion channel; one of the slots being located near one of the side edges of the housing and another of the slots being located between the side edges of the housing;

the inner surfaces of the slots in the insulative housing including an internal wall face, the internal wall face joined to two opposed side wall faces, the side wall faces forming two symmetric projecting bars which define symmetric grooves formed between the two projecting bars and the internal wall face, where side edges of the base portion of the terminals forming interfering tabs which mechanically engage the two symmetric grooves;

the contact portion of the terminal further including a projecting face, the-projecting face being located at one side of a central axis of the connector insertion channel of the insulative housing, and the mating audio connector is inserted into the connector insertion channel and electrically engages the projecting face; and the insulative housing further including a slit and one switch terminal received in the slit, an end of the switch terminal electrically engaging the free end of the resilient arm of the terminal and designed to disengage from the free end when a mating audio connector is inserted through the aperture into the connector receiving channel.

* * * * *

UNITED STATES PATENT AND TRADEMARK OFFICE

CERTIFICATE OF CORRECTION

PATENT NO. : 7,112,099 B2
APPLICATION NO. : 10/545154
DATED : September 26, 2006
INVENTOR(S) : Xuedong Ma It is certified that error appears in the above-identified patent and that said Letters Patent is hereby corrected as shown below:

On Title page item 75
The name of inventor, which currently reads "Zuedong Ma," should read --Xuedong Ma.--

Signed and Sealed this

Twelfth Day of December, 2006

JON W. DUDAS
*Director of the United States Patent and Trademark Office*